US007011615B2

(12) United States Patent
Price et al.

(10) Patent No.: US 7,011,615 B2
(45) Date of Patent: Mar. 14, 2006

(54) METHOD FOR MAKING A MULTICOMPARTMENT THERMOPLASTIC BAG

(75) Inventors: William D. Price, Midland, MI (US); Richard R. Dawkins, Saginaw, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 7 days.

(21) Appl. No.: 10/180,739

(22) Filed: Jun. 26, 2002

(65) Prior Publication Data

US 2003/0021500 A1 Jan. 30, 2003

Related U.S. Application Data

(63) Continuation-in-part of application No. 09/851,846, filed on May 9, 2001, now Pat. No. 6,579,008, which is a continuation-in-part of application No. 09/005,396, filed on Jan. 9, 1998, now Pat. No. 6,234,675.

(51) Int. Cl.
*B31B 1/60* (2006.01)

(52) U.S. Cl. ..... 493/210; 493/186; 493/197; 493/198; 493/202; 493/212; 493/213; 493/224; 493/243; 383/41

(58) Field of Classification Search ..... 493/186, 493/193, 194, 195, 196, 197, 198, 202, 210, 493/214, 223, 224, 238, 243, 261, 262, 201, 493/213, 212, 226; 383/19, 20, 38, 41
See application file for complete search history.

(56) References Cited

U.S. PATENT DOCUMENTS

| | | | | |
|---|---|---|---|---|
| 225,540 A | | 3/1880 | Terry | |
| 927,339 A | | 7/1909 | Earle | |
| 1,166,772 A | | 1/1916 | Lockhart | |
| 1,211,025 A | | 1/1917 | Wright | |
| 2,479,700 A | | 8/1949 | Pritchard | |
| 2,704,098 A | | 3/1955 | Pocock | |
| 2,757,699 A | | 8/1956 | Fancher et al. | |
| 2,774,402 A | | 12/1956 | Wikle | |
| 2,775,082 A | * | 12/1956 | Vogt | 53/469 |
| 3,023,948 A | | 3/1962 | Hoeppner | |
| 3,339,824 A | | 9/1967 | Luke | |
| 3,363,826 A | | 1/1968 | Behler | |
| 3,469,768 A | | 9/1969 | Repko | |
| 3,548,723 A | * | 12/1970 | Sengewald | 493/194 |
| 3,802,919 A | | 4/1974 | Saffir | |
| 3,960,314 A | * | 6/1976 | Faiers | 383/87 |

(Continued)

FOREIGN PATENT DOCUMENTS

DE 23 08 436 8/1974

(Continued)

OTHER PUBLICATIONS

Search Report issued by the European Patent Office for PCT Application No. PCT/US98/00412; report dated May 12, 1998.

*Primary Examiner*—Louis K. Huynh
*Assistant Examiner*—Christopher Harmon

(57) ABSTRACT

A method of making a multicompartment reclosable thermoplastic bag having at least two compartments is disclosed. Each compartment has a top, a bottom, two side edges, and two opposing sidewalls joined at the side edges and the bottom. Each compartment has a closure across the top thereof, which are arranged back-to-back and aligned. The compartments are attached together proximate the tops of the compartments, and the bottoms of the compartments are free from being attached to each other. Processes for making such bags from one or more webs are also disclosed.

15 Claims, 9 Drawing Sheets

U.S. PATENT DOCUMENTS

| | | | | | |
|---|---|---|---|---|---|
| 4,046,408 | A | | 9/1977 | Ausnit | |
| 4,256,256 | A | | 3/1981 | Meyers | |
| 4,312,473 | A | | 1/1982 | Hoeller | |
| 4,560,068 | A | | 12/1985 | Membrino | |
| 4,629,524 | A | | 12/1986 | Ausnit | |
| 4,635,294 | A | | 1/1987 | Bentsen | |
| 4,744,673 | A | | 5/1988 | Nakamura | |
| 4,756,628 | A | | 7/1988 | Branson | |
| 4,927,405 | A | | 5/1990 | Martin et al. | |
| 4,951,863 | A | | 8/1990 | Templet | |
| 4,993,844 | A | | 2/1991 | Robinson et al. | |
| 5,024,536 | A | | 6/1991 | Hill | |
| 5,056,930 | A | | 10/1991 | Mestetsky | |
| 5,100,000 | A | | 3/1992 | Huseman | |
| 5,102,234 | A | | 4/1992 | Levy | |
| 5,116,301 | A | | 5/1992 | Robinson et al. | |
| RE34,117 | E | | 10/1992 | Martin et al. | |
| 5,221,567 | A | * | 6/1993 | Baker | 428/43 |
| 5,425,825 | A | * | 6/1995 | Rasko et al. | 156/66 |
| 5,492,705 | A | | 2/1996 | Porchia et al. | |
| 5,542,902 | A | * | 8/1996 | Richison et al. | 493/195 |
| 5,618,111 | A | | 4/1997 | Porchia et al. | |
| 5,797,828 | A | * | 8/1998 | Selle et al. | 493/225 |
| 5,803,889 | A | * | 9/1998 | Littman | 493/267 |
| 5,947,279 | A | | 9/1999 | Lee et al. | |
| 5,971,155 | A | | 10/1999 | Liang | |
| 6,162,158 | A | * | 12/2000 | Mercer et al. | 493/288 |
| 6,234,675 | B1 | | 5/2001 | Saad et al. | |
| 6,254,520 | B1 | * | 7/2001 | Angless | 493/243 |
| 6,440,051 | B1 | | 8/2002 | Lauzon et al. | |

FOREIGN PATENT DOCUMENTS

| | | | |
|---|---|---|---|
| EP | 452167 | A | 10/1991 |
| EP | 453157 | A | 10/1991 |
| FR | 047089 | | 10/1914 |
| GB | 747651 | | 4/1956 |
| WO | WO 98/33717 | | 8/1998 |

* cited by examiner

METHOD FOR MAKING A MULTICOMPARTMENT THERMOPLASTIC BAG

CROSS REFERENCE TO RELATED APPLICATIONS

This is a continuation-in-part of U.S. patent application Ser. No. 09/851,846, filed on May 9, 2001 now U.S. Pat. No. 6,579,008, which is a continuation-in-part of U.S. patent application Ser. No. 09/005,396, filed on Jan. 9, 1998, now U.S. Pat. No. 6,234,675.

FIELD OF THE DISCLOSURE

The present disclosure generally relates to reclosable thermoplastic bags and, more particularly, to reclosable thermoplastic bags having multiple compartments.

BACKGROUND

Reclosable thermoplastic bags are commonly used in food packaging. The bags are generally made out of a plastic film and have two side walls that are folded at the bottom and sealed at the sides. The bags typically have a reclosable fastener at the top of the bag, such as, for example, an adhesive, a wire tie, or a plastic zipper such as that described in U.S. Pat. No. 5,140,727, issued to Dais, et al.

The consumers that use these bags often need more than one bag at any given time. Therefore, bags having more than one compartment have been developed. For example, U.S. Pat. No. 4,993,844 discloses a compartmented pouch. However, the closures in the pouch of the '844 patent are displaced relative to one another, making it difficult for a consumer to close one compartment without squashing the contents of another compartment. Furthermore, the '844 patent describes a shared wall for the compartments, which restricts the available volume inside the compartment.

Another example is U.S. Pat. No. 5,024,536, which describes a resealable compartmented bag. However, the '536 patent describes the compartments of the bag as being sealed together along the bottom edges of the compartments, thereby restricting the available volume inside the compartments.

It would therefore be an advance in the art of compartmented bags to provide a multicompartment bag, and method for making the same, in which all of the compartments can be closed simultaneously but opened independently of one another, and in which the available volume inside the compartments is maximized. Moreover, improving the ease with which the individual compartments can be grasped and manipulated would be advantageous.

SUMMARY OF THE DISCLOSURE

According to one aspect on the disclosure, a method of making a storage bag is provided. The method may include the steps of providing a web of thermoplastic film, adding at least one closure element to the web, cutting the web at a predetermined location on the web to create a first sheet and a second sheet, folding the first and second sheets to form bottom edges in first and second compartments, sealing side edges, and joining the first and second compartments to form a multicompartment bag. Top edges of both the first and second compartments remain unsealed to create a mouth at the top edge of each compartment. Further, both the first and the second compartments have closure elements proximate the top edges of each compartment.

According to another aspect of the disclosure, a method of making a storage bag is provided including the steps of providing a first web and a second web and adding a first closure element on at least a portion of the first web and a second closure element on at least a portion of the second web. Then, the method requires that the first web be folded to form a bottom edge of a first compartment and the second web be folded to form a bottom edge of a second compartment. Next, the a first side edge and a second side edge of the first compartment are sealed. Similarly, a first side edge and a second side edge of the second compartment are sealed. The first compartment has a mouth at a top edge, and the second compartment has a mouth at a top edge. Finally, the first compartment and the second compartments are joined so that the closure element of the first compartment is proximate the top edge of the first compartment and the closure element of the second compartment is proximate the top edge of the second compartment. Each closure element of the bag comprises a first mating strip and a second mating strip.

In one embodiment of the present disclosure, a storage bag includes a first compartment having interior and exterior walls joined along first and second side edges and a bottom edge. The first compartment additionally has a mouth proximate a top edge of the interior wall and a top edge of the exterior wall. The storage bag further includes a second compartment having interior and exterior walls joined along first and second side edges and a bottom edge. The second compartment additionally has a mouth proximate a top edge of the interior wall and a top edge of the exterior wall. The interior wall top edge of the first compartment is joined with the interior wall top edge of the second compartment. And, the first compartment and second compartments are imperforate.

These and other aspects and features of the disclosure will become more apparent upon reading the following detailed description when taken in conjunction with the accompanying drawings.

Figure 1:
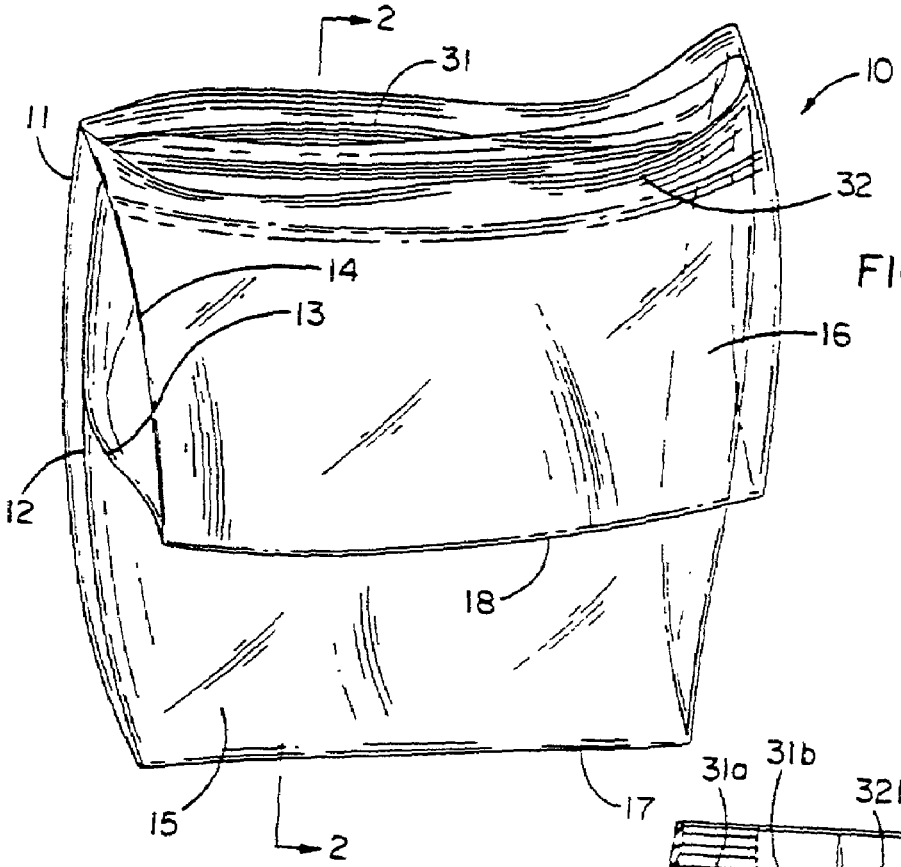
FIG. 1 is a perspective view of a multicompartment thermoplastic bag constructed in accordance with the teachings of the present disclosure.

While the disclosure is susceptible to various modifications and alternative constructions, certain illustrative embodiments thereof have been shown in the drawings and will be described below in detail. It should be understood, however, that there is no intention to limit the invention to the specific forms disclosed but, on the contrary, the intention is to cover all modifications, alternative constructions, and equivalents falling within the spirit and scope of the invention as defined by the appended claims.

DETAILED DESCRIPTION OF THE DISCLOSURE

FIG. 1 illustrates a multicompartment reclosable thermoplastic bag 10 constructed in accordance with the teachings of the present disclosure. Bag 10 includes at least two compartments 15 and 16. Each compartment 15 and 16 has a top, a bottom, side edges, and two opposing sidewalls joined at the side edges and the bottom. Thus, compartment 15 has a bottom edge 17 and two opposing side edges. Compartment 16 likewise has a bottom edge 18 and two opposing side edges. Each compartment also has a closure element across the top thereof. Thus, compartment 15 has closure 31 across the top thereof, while compartment 16 has closure 32 across the top thereof. The bag 10 also includes means for joining the compartments 15 and 16 proximate to the tops thereof.

Each sidewall of compartments 15 and 16 is made of a layer of thermoplastic film. Thus, bag 10 includes at least four layers of film 11, 12, 13, and 14. Each layer 11, 12, 13, and 14 has a top edge, a bottom edge and two opposing side edges. Layers 11 and 12 are attached along the bottom and the side edges to form the compartment 15. Layers 13 and 14 are attached along the bottom and the side edges to form the compartment 16. Thus, as shown, layer 11 is an outer layer of the first compartment, while layer 12 is an inner layer of the first compartment. Likewise, layer 14 is an outer layer of the second compartment while layer 13 is an inner layer of the second compartment.

Figure 2:
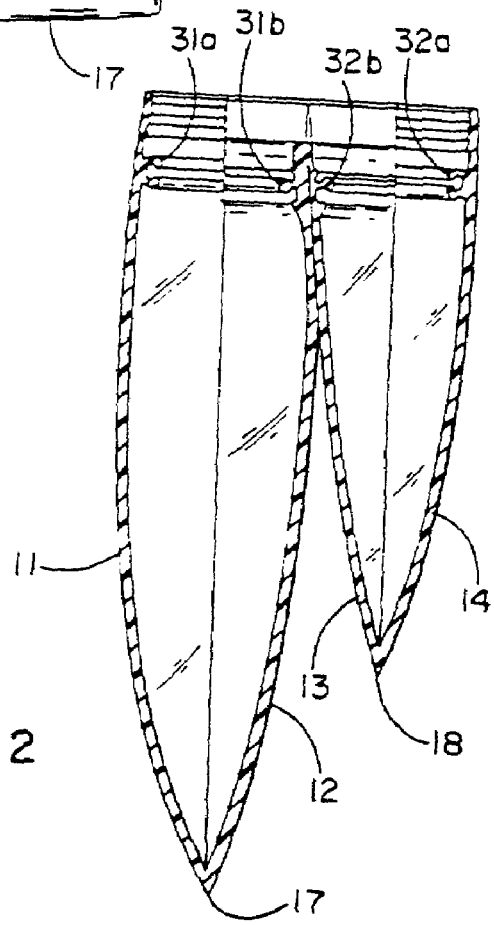
FIG. 2 is a sectional view of the bag of FIG. 1.

FIG. 2 illustrates a sectional view of an embodiment of the bag 10. The layers 11, 12, 13, 14 can be made from any suitable thermoplastic film such as, for example, low density polyethylene, linear low density polyethylene, substantially linear copolymers of ethylene and a C3–C8 α-olefin, polypropylene, polyvinylidene chloride, ethylene vinyl acetate, polylactic acid, mixtures of two or more of these polymers, or mixtures of one of these polymers with another thermoplastic polymer. The film can be a co-extruded film, if desired.

Bottom edge 17 of compartment 15 and bottom edge 18 of compartment 16 can be formed using any desired method. For example, the bottom edges can be formed by folding the film, by heat sealing, by ultrasonic sealing, by an adhesive seal, or by any other desired method.

The side edges of compartments 15 and 16 are formed by joining layers of film along the side edges thereof using any desired method. For example, the side edges can be formed by hot wire sealing, hot knife sealing, ultrasonic sealing, an adhesive seal, or by any other desired method. The result is that every two layers of film are joined together such that two layers together form a compartment. Thus, in FIGS. 1 and 2, layers 11 and 12 are joined together to form compartment 15, while layers 13 and 14 are joined together to form compartment 16. If desired all layers can be joined along the side edges.

The bag 10 includes means for joining compartment 15 and compartment 16 proximate to the tops of the compartments, so that the bag 10 is a single unit. Compartments 15 and 16 can be joined, proximate to the tops, in any desired manner. For example, the compartments can be joined by a continuous or intermittent heat seal or ultrasonic seal.

Figure 3:
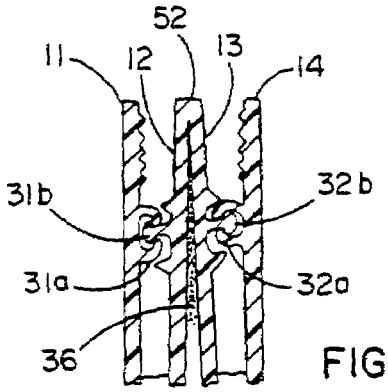
FIG. 3 is a sectional view of a closure used in the bag of FIG. 1.

Alternatively, as shown in FIG. 3, the compartments can be joined by a fold 52 in the film at the top of the bag between layers 12 and 13. Fold 52 can be above or below the fasteners. In a preferred embodiment, fold 52 extends about 0.5 inches above the bottom of the fasteners.

Alternatively, the means for joining compartments 15 and 16 can be an adhesive 36 disposed continuously or intermittently between layers 12 and 13. The adhesive is preferably applied to a point proximate to the closures. Suitable adhesives include any adhesive that provides sufficient adhesion to the film layers 12 and 13 so that the layers remain attached while compartments 15 and/or 16 are opened. Examples of such adhesives include HM2707 and HL2203, available commercially from H. B. Fuller. An adhesive is especially useful when closure elements are disposed along both layers 12 and 13, in order to stabilize and align the closures.

Compartments can be joined by any other suitable means, such as, for example, by extruded lamination of a polymer such as low density polyethylene. The effect of joining the compartments proximate to the top is to minimize movement of the aligned closure elements with respect to each other. When movement of the closures is minimized, it is easier for a consumer to close the compartments simultaneously and to open one or more compartments.

As shown in FIG. 3, in a preferred embodiment, both a fold 52 and an adhesive 36 are used as means for joining the compartments. In this embodiment, the adhesive 36 is applied from the point of fold 52 down to a point at least between the profiles 31*b* and 32*b*. This distance can be as high as 0.5 inches (12.7 mm), although preferably the adhesive is applied in a band having a width of from about ⅛ inch (3.17 mm) to about 1/16 (1.59 mm). Preferably, the adhesive is applied between the profiles 31*b*, 32*b*, or above the profiles 31*b*, 32*b*.

The bag 10 includes a closure disposed along the top of each compartment, so that each compartment 15 and 16 has a complete closure across the top. The term "closure element" is defined herein to mean one part of a closure. For example, on a zipper closure, a closure element is one profile or the other of the zipper, e.g., a rib profile or a groove profile. On an adhesive closure, a closure element is one adhesive strip or the other. The closure elements can be post-applied, integral or laminated to the film, all of which are commonly known methods of applying closures to reclosable thermoplastic bags.

In one embodiment, a double-sided zipper tape can be laminated to the tops of layers 12 and 13. A double-sided zipper tape is one in which both sides of the zipper tape have a profile of a plastic zipper on it, i.e., a rib profile or a groove profile. The profiles extend outwardly from each side of the zipper tape such that a single zipper tape contains two profiles extending therefrom.

Figure 6:
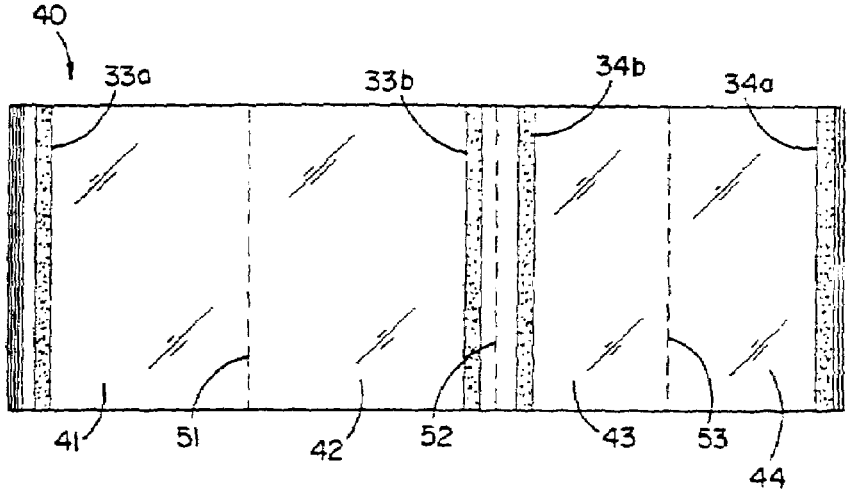
FIG. 6 is a plan view of an extruded sheet used to make a multicompartment bag employing adhesive closures.

FIG. 3 illustrates a sectional view of closures 31 and 32 which can be used for the present invention. Closures 31 and 32 can be any suitable closures. For example, as shown, closure 31 can be a plastic zipper having interlockable profiles 31*a* and 31*b*, and closure 32 can also be a plastic zipper having interlockable profiles 32*a* and 32*b*. However, the closures can be adhesive closures or any other suitable reclosable closures, if desired, as shown in FIG. 6, wherein adhesive closure strips are shown at 33*a*, 33*b*, 34*a* and 34*b*.

The profiles 31*a*, 31*b*, 32*a* and/or 32*b* of the plastic zipper are disposed along the tops of layers 11, 12, 13, and 14, so that each compartment has a complete closure along the top thereof. The closure on any two compartments need not be the same, although they can be. For example, one compartment might have a plastic zipper while another compartment might have an adhesive closure.

Figure 9:
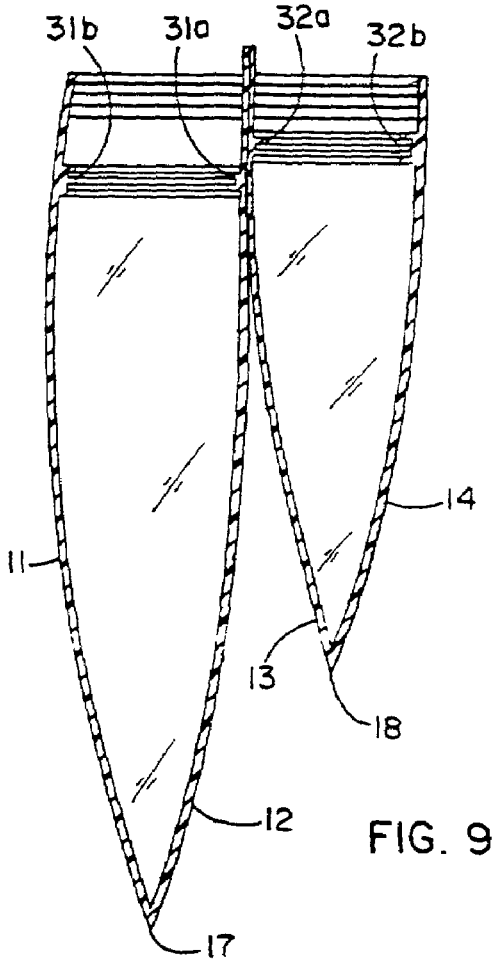
FIG. 9 is a sectional view of an alternative embodiment of a multicompartment bag constructed in accordance with the teachings of the disclosure.

The closures on each compartment are substantially aligned with each other such that all of the compartments can be closed with a single motion on the part of a consumer. In this manner, all of the compartments can be closed simultaneously. The term "aligned" is defined herein to mean that the center points of the profiles are lined up such that, as seen from a front view, only one closure element can be seen, with all of the other closure elements being lined up substantially behind that closure element and thus substantially hidden from view. Preferably, the closure elements are aligned such that the center points are less than or equal to ½ inch (1.27 cm) away from each other. More preferably, the center points are ¼ inch (0.63 cm) away from each other, and most preferably, the center points are ⅛ inch (0.32 cm) away from each other. FIGS. 2 and 9 depict two examples of closures which are aligned according to the teachings of the disclosure.

As shown in FIGS. 1–3, the closures are positioned such that the rib profiles 31*b* and 32*b* are aligned with each other. In the embodiment shown, the rib profiles are positioned back-to-back. The term "back-to-back" is defined herein to mean that the closure elements are positioned substantially adjacent to each other but extend away from each other. In the embodiment shown, closure element 31*b* is positioned adjacent closure element 32*b*, and closure elements 31*b* and 32*b* are positioned such that the closure face away from each other. Thus, closure elements 31*b* and 32*b* are said to be aligned back-to-back.

Back-to-back alignment facilitates the ability of a consumer to interlock both closures 31 and 32 on both compartments 15 and 16 in a single motion. On the other hand, closures 31 and 32 can be opened independently from one another, such that one compartment can be opened while the other compartment remains closed.

In one embodiment, the bag can be designed such that one closure will open preferentially. In other words, when the bag has two adjacent compartments with plastic zippers disposed across the tops thereof, the force required to open one of the plastic zippers can be modified to be greater than the force required to open the other plastic zipper. The opening force can be modified using any desired means. For example, the opening force of a plastic zipper can be modified by altering the profile geometry. Examples include making the groove of one groove profile bigger or making the rib of one rib profile thinner, or altering one or more of the radii of the various hooks in the closure. Alternatively, the opening force of a plastic zipper can be modified by changing the type of plastic to one that has different friction characteristics.

The compartments can be of equal size, although they need not be. Preferably, the compartments all have equal width, although the depths of the compartments can vary. For example, all of the compartments might have a 6.5 inch (16.51 cm) width and an 8 inch (20.32 cm) depth. Alternatively, all of the compartments might have a 6.5 inch (16.51 cm) width, while one compartment has an 8 inch (20.32 cm) depth and another compartment has a 6 inch (15.24 cm) depth.

Figure 8:
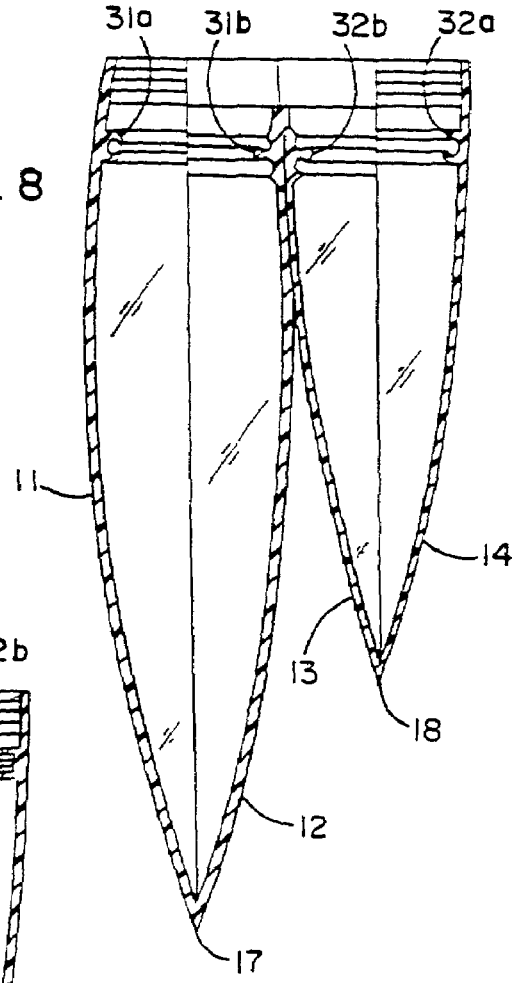
FIG. 8 is a sectional view of the bag of FIG. 1, illustrating compartment sidewalls of differing thickness.

The thicknesses of the layers of film can be equal or the thicknesses can vary as shown in FIG. 8. For example, if desired, all of layers 11, 12, 13 and 14 can have a thickness in the range of from 2.5 mils (0.0635 mm) to 5.0 mils (0.127 mm). Such a range is a typical thickness range of a ZIPLOC® brand freezer bag. Alternatively, the layers can all have thicknesses in the range from 1.75 mils (0.0445 mm) to 2.7 mils (0.0686 mm). Such a range is a typical thickness range of a ZIPLOC® brand storage bag. The layers 11, 12, 13 and 14 can all also have thicknesses in the range of from 1.0 mils (0.0254 mm) to 1.2 mils (0.0305 mm), which is a typical thickness range of a ZIPLOC® brand sandwich or snack bag. On the other hand, the layers 11, 12, 13, and 14 can all have different thicknesses, which can be any combination of the above thicknesses. Moreover, one or more of layers 11, 12, 13 and/or 14 can be even thinner, from 0.6 mils (0.0152 mm) to 1.2 mils (0.0305 mm). The desired thickness of the various layers depends upon the final use of the multicompartment bag. For example, thicker layers of film are general useful for longer term storage, whereas thinner film thicknesses are useful for items which will be used in the short term. Thinner layers also tend to cling to the packaged material better than thicker layers.

If desired, one or more of the layers can be microperforated. The term "microperforated" means that the film has small holes therein. Such a microperforated film makes the compartment suitable for storing produce therein, as the microperforated film allows the produce to breathe. Preferably, the microperforations, or holes, have a size in the range of from 200 microns to about 900 microns. If desired, different layers can have different patterns of microperforations therein. For example, layer 12 might have microperforations in the range of from 200 to 300 microns, while layer 13 can have microperforations of from 800 to 900 microns. Preferably, the density of the microperforations is from 100 microperforations to 500 microperforations per layer of film, for a 6.625 inch (16.83 cm) by 7 inch (17.78 cm) layer of film. The microperforations can be evenly dispersed across a layer or can be clustered in groups of several microperforations. Furthermore, different layers of film can have different patterns of microperforations. Generally, any combinations of patterns of microperforations can be used. The microperforations can be formed using any conventional method such as a hot needle perforator. More details about microperforated bags are described in U.S. Pat. No. 5,492,705, incorporated herein by reference.

If desired, one or more of the layers can be embossed. Embossing creates a texture on the surface of the film. Embossing thus provides a visual cue to the consumer that one layer of film is different than the other layers, as the texture scatters the light differently, thereby changing the appearance of the film. Moreover, the textured surface adheres to the stored food better than a smooth surface does. Any combination of layers can be embossed.

Figure 4:
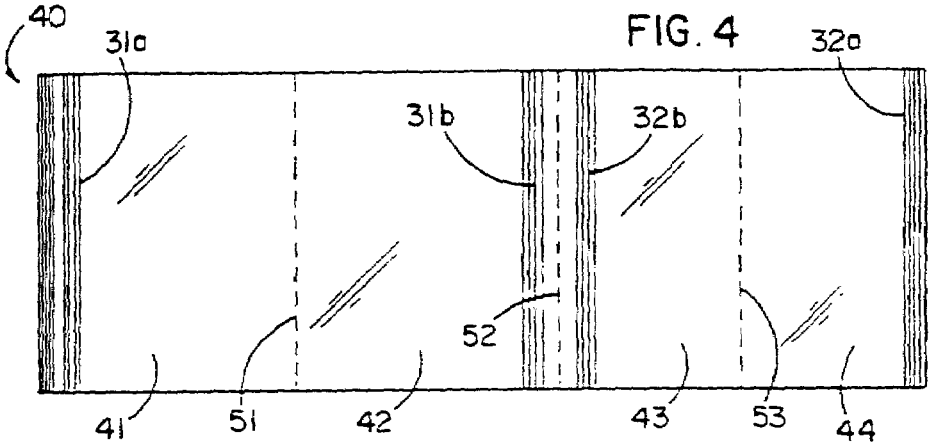
FIG. 4 is a plan view of an extruded sheet used to make a multicompartment bag according to the teachings of the present disclosure.

The preferred method of making the bag of the present invention begins with an extrusion process well known in the art. The bag is made with a large extruded sheet of thermoplastic film. FIG. 4 illustrates an example of such an extruded sheet 40 that can be used to make the bag of the present invention. The sheet 40 comprises at least four panels 41, 42, 43 and 44, each panel representing a layer of film in the final bag. Thus, the panels 41, 42, 43 and 44 correspond to the layers 11, 12, 13 and 14 in the bag shown in FIGS. 1–2. The panels 41, 42, 43 and 44 can be the same size, or the size of the panels can vary according to the desired size of the final compartments.

Figure 7:
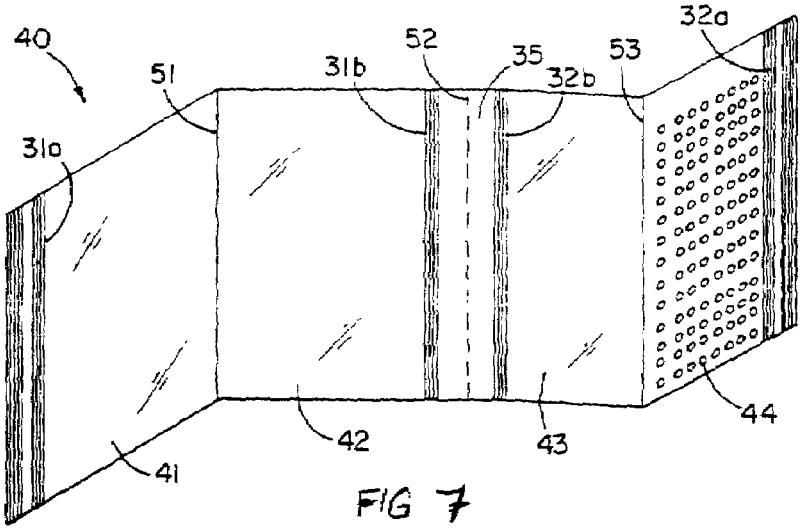
FIG. 7 is a perspective view of the sheet of FIG. 4 illustrating the use of zipper tape.

As shown, extruded sheet 40 contains profiles 31*a*, 31*b*, 32*a* and 32*b* integral therewith. However, if desired, profiles 31*a*, 31*b*, 32*a* and 32*b* can be post-applied, i.e., applied after the film is extruded, or profiles 31*a*, 31*b*, 32*a*, and 32*b* can be attached to the sheet by laminating a zipper tape thereto. In one embodiment, a double-sided zipper tape having profile 31*b* on one side thereof and profile 32*b* on the other side, can be laminated to the sheet. As shown in FIG. 7, a zipper tape 35 may be centered over fold lines 52, so that profiles 31*b* and 32*b* are positioned in such a manner that they will be back-to-back when the sheet is folded on fold line 52. When the profiles are extruded integrally with sheet 40, preferably, profiles 31*b* and 32*b* are side by side on the sheet 40, so that when the sheet 40 is folded, as described below, the profiles 31*b* and 32*b* are back to back.

If desired, any or all of the panels 41, 42, 43 or 44 can be microperforated or embossed as shown in FIG. 7. In this manner, the final bag will have some or all layers which will be microperforated or embossed. Furthermore, if the final bag is to have layers of varying thicknesses, the extruder die lip can be designed such that the die gap varies, thereby forming an extruded sheet 40 that has multiple thicknesses. When the sheet 40 is folded, as described below, the layers will then have varying thicknesses.

Figure 5:
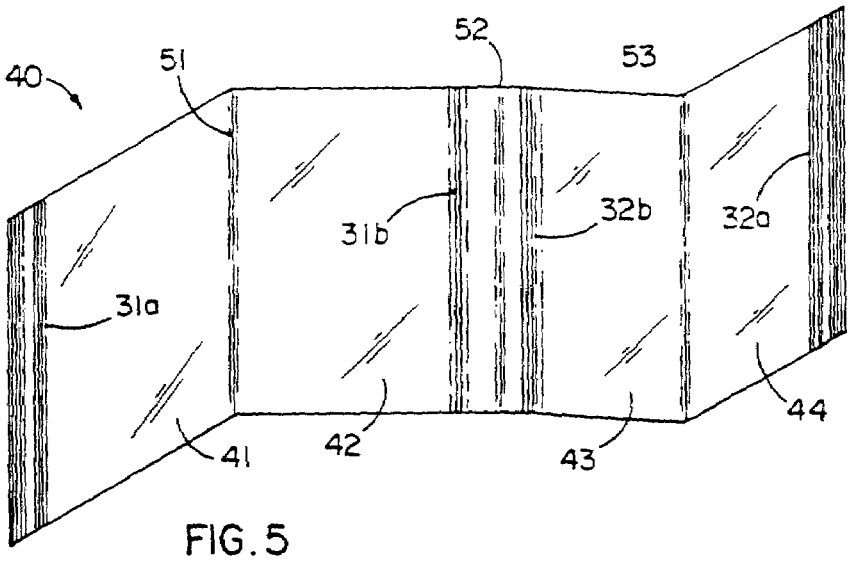
FIG. 5 is a perspective view of the sheet of FIG. 4.

FIG. 5 illustrates the manner in which the sheet 40 can be folded to make the bag of the present invention. The sheet 40 can be folded along lines 51, 52 and 53. The folds will form the bottom edges 17 and 18 along the fold lines 51 and 53, respectively.

The fold along line 52 will position the profiles 31*b* and 32*b* back to back. Fold line 52 is also the point at which the compartments 15 and 16 are joined. The fold along lines 51 and 53 enable the profiles 31*a* and 32*a* to be aligned with profiles 31*b* and 32*b* to close the compartments. Preferably, the extruded sheet is thinner proximate to the fold line 52, referred to herein as the "thinner section." The thinner section permits easier folding. More preferably, the thinner section is less than or equal to half as thick as the rest of the extruded sheet. Even more preferably, the thinner section is from 0.5 mils (0.0127 mm) to 2.0 mils (0.0508 mm) thick and yet even more preferably from 1.0 mils (0.0254 mm) to 1.5 mils thick (0.0381 mm). If the thinner section is too thin, the sheet will tear easily, whereas if the thinner section is too thick, the sheet will not fold easily. Preferably, the thinner section is ¼ inch (6.35 mm) wide or less.

If desired, as the extruded sheet 40 is being folded, the adhesive can be disposed along the back of the sheet on either side of the fold line 52. In this manner, when the sheet 40 is folded, the compartments will be joined by the fold as well as by the adhesive disposed along the sheet. The adhesive allows better alignment of the zipper profiles, because profiles 31*b* and 32*b* will be held in place and free from movement with respect to one another. Normally, the compartments are also joined by the side seals.

After the sheet is folded and the adhesive is applied, the sheet is heat sealed along the edges of the bag. The heat sealing permeates all of the panels, or layers of the bag. The heat seal can be accomplished by use of a hot wire, a hot knife, or any other desired means. In this manner, the side edges of the compartments are formed.

If desired, the sheet can be corona-treated before being folded. Corona treating permits printing to be easily applied to the bag surface. For example, a stripe can be printed along the bottom of one or more of the compartments in order to give a visual cue to the consumer as to the location of the bottom of the compartment.

Figure 10:
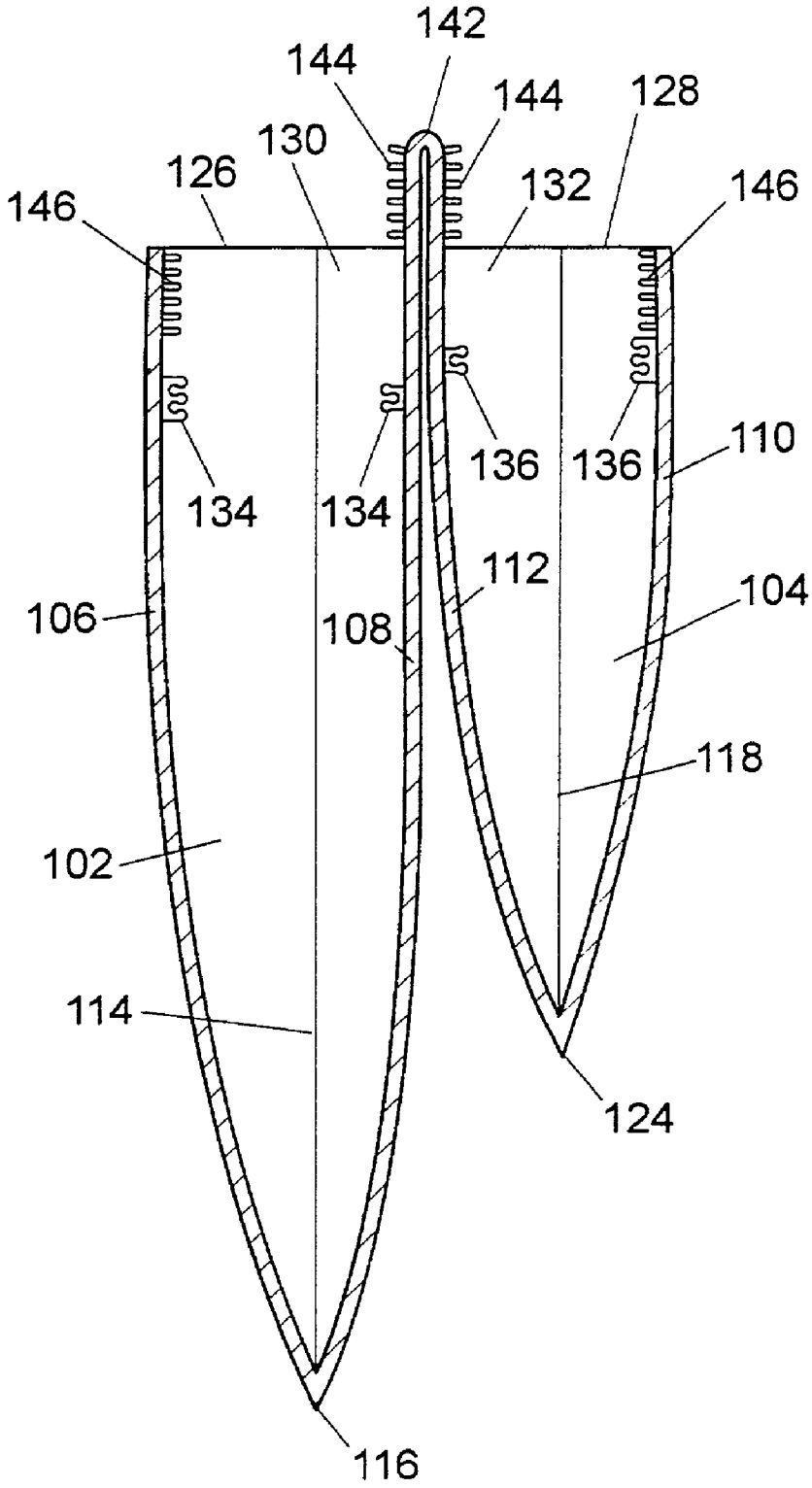
FIG. 10 is a sectional view of another embodiment of a bag constructed in accordance with the teachings of the disclosure.

Referring now to FIG. 10, an embodiment of a bag constructed in accordance with the teachings of the disclosure is generally referred to by reference numeral 100. As shown therein, the bag 100 includes a first compartment 102 and a second compartment 104. The first compartment 102 includes an exterior wall 106 and an interior wall 108 while the second compartment 104 includes an exterior wall 110 and an interior wall 112. The first compartment 102 is sealed along a first side edge 114 (and an undepicted second side edge) and along a bottom edge 116. Similarly, the second compartment 104 is sealed along a first side edge 118 (and an undepicted second side edge), as well as a bottom edge 124. The top edges, 126 and 128 respectively of the first and second compartments 102 and 104 are unsealed, thereby providing mouths 130, 132 for each compartment. A closure element 134 is provided to close the first compartment 102, and a second closure 136 is provided to close the second compartment 104.

The bag 100 is provided with a handle 138 to facilitate grasping of the bag, and opening the first and second compartments 102 and 104. In the depicted embodiment, the handle 138 is provided by interior walls 108 and 112, which extend above the exterior walls 106 and 110. In so doing, the bag 100 includes a raised center lip including upper portions of the interior walls 108 and 112, as well as a fold 142. In the depicted embodiment, the raised lip 140 extends the entire width of the bag 100, but it is to be understood that in alternative embodiments, the raised lip 140 need not extend along the entire width of the bag 100. In the preferred embodiment, the raised lip 140 is textured in the form of a plurality of lateral ribs 144 to improve the grip of the user. The exterior walls 106, 110 may similarly include ribs 146.

In an exemplary embodiment, the inventor has found that the raised center lip 138 having a height $\alpha$ of one quarter of an inch on a bag 100 having a height $\alpha$ of seven inches is advantageous. The center lip being measured from the top edges 126, 128 to the fold 142. In another embodiment the center lip 138 may be of different distances from the top edges 126, 128. For example, the fold 142 may be one half inch from the top edge 126, and one quarter inch from the top edge 128.

Figure 11:
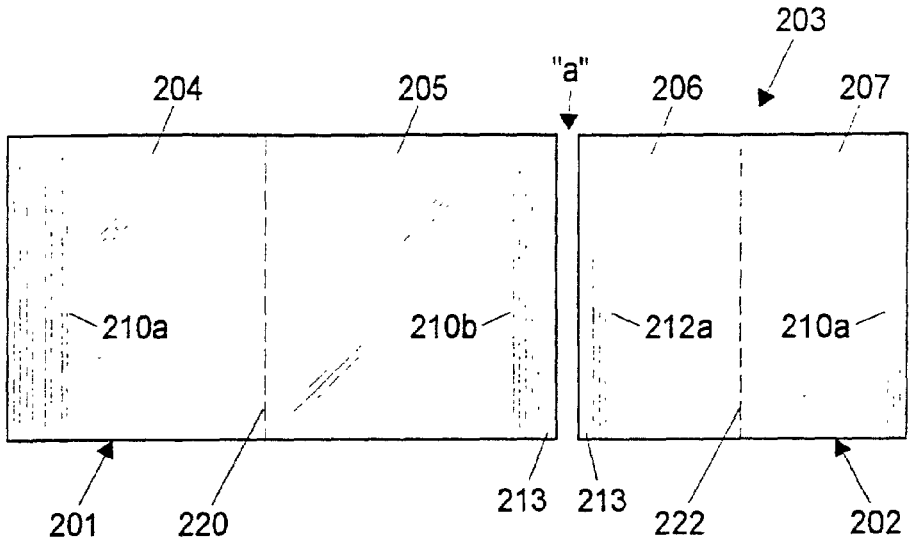
FIG. 11 is a plan view of two extruded sheets used to make a multicompartment bag according to the teachings of the present disclosure.

In another embodiment of the present disclosure, a bag 200 may be made from two sheets 201, 202 of thermoplastic film rather than a unitary, continuous sheet of extruded film. As shown in FIG. 11, the bag 200 may be made from an extruded sheet 203 that is cut or separated into the two sheets 201 and 202. The sheets 201 and 202 may include at least four panels 204, 205, 206 and 207, each panel representing a layer of film in the finished bag 200. Thus, the panels 204, 205, 206 and 207 correspond to the panels 41, 42, 43 and 44 of the extruded sheet 40 of FIG. 4. The panels 204, 205, 206 and 207 can be the same size, or the size of the panels can vary according to the desired size of the final compartments.

The sheets 201 and 202 are depicted as including closure elements 210*a*, 210*b*, 212*a* and 212*b* integral therewith.

However, if desired, the closure elements 210*a*, 210*b*, 212*a* and 212*b* can be post-applied, i.e., applied after the film is extruded. The post-applied elements 210*a*, 210*b*, 212*a* and 212*b* can be attached to the sheets 201 and 202 by laminating a zipper tape (not shown) thereto. In one embodiment, a double-sided zipper tape having closure element 210*b* on one side thereof and the closure element 212*b* on the other side, can be laminated to the sheet. When the closure elements 210*a*, 210*b*, 212*a* and 212*b* are extruded integrally with sheets 201 and 202, preferably, the sheets 201 and 202 are cut or separated at a predetermined location, identified by an arrow "a," to ensure that the closure elements 210*b* and 212*b* may be later joined to be side by side on the sheets 201 and 202 after each sheet 201 and 202 is folded, as described below.

If desired, any or all of the panels 204, 205, 206 and 207 can be microperforated or embossed as is shown in FIG. 7. In this manner, the finished bag 200 will have some or all layers which will be microperforated or embossed. Furthermore, if the bag 200 is to have layers of varying thickness, the extruder die lip can be designed, as is known in the art, such that the die gap varies, thereby forming the extruded sheet 200 with multiple thicknesses.

FIG. 11 illustrates the single extruded sheet 203 cut or separated to create the first sheet 201 and the second sheet 202. Additionally, FIG. 11 shows folds along lines 220 and 222 which indicate where the first sheet 201 and the second sheet 202 can be folded to form bottom edges 224 and 226, respectively.

When the sheets 201, 202 are folded along lines 220 and 222, closure elements 210*a* and 210*b* are substantially aligned with closure elements 212*a* and 212*b*. Preferably, the extruded sheet 203 is thinner proximate the location "a" in which sheets 200 and 201 are separated, referred to herein as the thinner sections 213. The thinner sections 213 have the same specifications as described above in connection with extruded sheet 40. The thinner sections 213 permit easy cutting or separation of the sheets 200 and 201.

Figure 12:
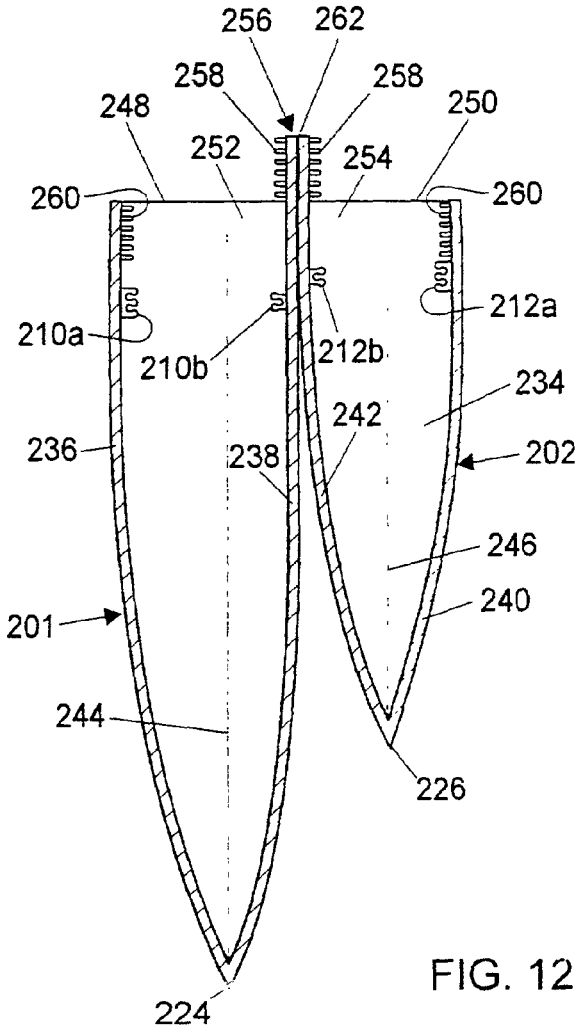
FIG. 12 is a sectional view of an alternative embodiment of a multicompartment bag constructed from the extruded sheets of FIG. 11.

FIG. 12 shows an embodiment of the finished bag 200. Bag 200 includes a first compartment 232 formed by the folded sheet 201 and a second compartment 234 formed by the folded sheet 202. Specifically, the first compartment 232 includes an exterior wall 236 and an interior wall 238 while the second compartment 234 includes an exterior wall 240 and an interior wall 242. The first compartment 232 is sealed along a first side edge 244 (and an undepicted second side edge). Similarly, the second compartment 234 is sealed along a first side edge 246 (and an undepicted second side edge). The bottom edges 224 and 226 are formed by folds in the thermoplastic material, depicted in FIG. 11 by reference numerals 220, 222, respectively. The side edges 244 and 246 (as well as the undepicted opposite side edges) may be heat sealed as through the use of a hot knife, a hot wire, or any other desired means wherein heat is transferred at a sufficient temperature and at specified locations so as to melt the thermoplastic material where appropriate and thereby allow the material of joined layers to fuse. In this manner, the side edges 244 and 246 of the compartments 232 and 234 are formed.

Referring again to FIG. 12, the top edges 248 and 250, respectively, of the first and second compartments 232 and 234 are unsealed, thereby providing mouths 252 and 254 for each compartment. Closure elements 210*a* and 210*b* are provided to close the first compartment 232, and closure elements 212*a* and 212*b* are provided to close the second compartment 234. Any closure element or profile described above in connection with alternate embodiments of a bag may be used in this embodiment of bag 200. The term "closure element" as used in connection with sheets 201 and 202 and bag 200 is the same as that used in connection with bag 10 as discussed above.

The bag 200 may be provided with an extension or raised center lip 256 to, among other things, facilitate grasping of the bag 200 and opening the first and second compartments 232 and 234. In the depicted embodiment in FIG. 12, the raised center lip 256 is created by interior walls 238 and 242, which extend above exterior walls 236 and 240. In doing so, the bag 200 includes the raised center lip 256 including joined upper portions of the interior walls 238 and 242.

In the depicted embodiment, the raised center lip 256 extends the entire width of the bag 200, but it is to be understood that in alternative embodiments, the raised center lip 256 need not extend along the entire width of the bag 200. In a preferred embodiment, the raised center lip 256 is textured in the form of a plurality of lateral ribs 258 to improve the grip of a user. The exterior walls 236 and 240 may similarly include ribs 260. In alternative embodiments, the bag 200 may be alternatively textured including, but not limited to, abrasive, etched, hardened or smooth surfaces. As described in connection with raised center lip 138, raised center lip 256 may have a height $\alpha$ of one quarter of an inch on a bag 200 having a height $\alpha$ of seven inches. It is to be understood that such dimensions are provided by way of example only and that other dimensions and ratios are possible.

The interior walls 238 and 242 may be joined together in a variety of manners such as, but not limited to, the use of an adhesive 262. The adhesive 262 maintains the alignment of the closure elements 210*b* and 212*b* so that the closure elements 210*b* and 212*b* will be held in place, free from movement with respect to one another. Adhesive 262 may be disposed continuously or intermittently between interior walls 238 and 242. Suitable adhesives include beads of low density hot plastic or any other adhesive that provides sufficient adhesion to the film layers 205 and 206 so that the layers remain attached while compartments 232 and 234 are opened. Examples of such adhesives and the placement of such adhesives as a means of joining the compartments are the same as those discussed above in connection with adhesive 36. Further, compartments 232 and 234 may be joined by any other suitable means, such as, but not limited to, extruded lamination of a polymer such as low density polyethylene as is discussed above, heat sealing, ultrasonic welding, stitching, spot welding, or the like. In addition, it is also possible to join the first and second compartments 232 and 234 by side seals (not shown). Top and/or bottom pleats (not shown) could also be added to the bag.

Figure 13:
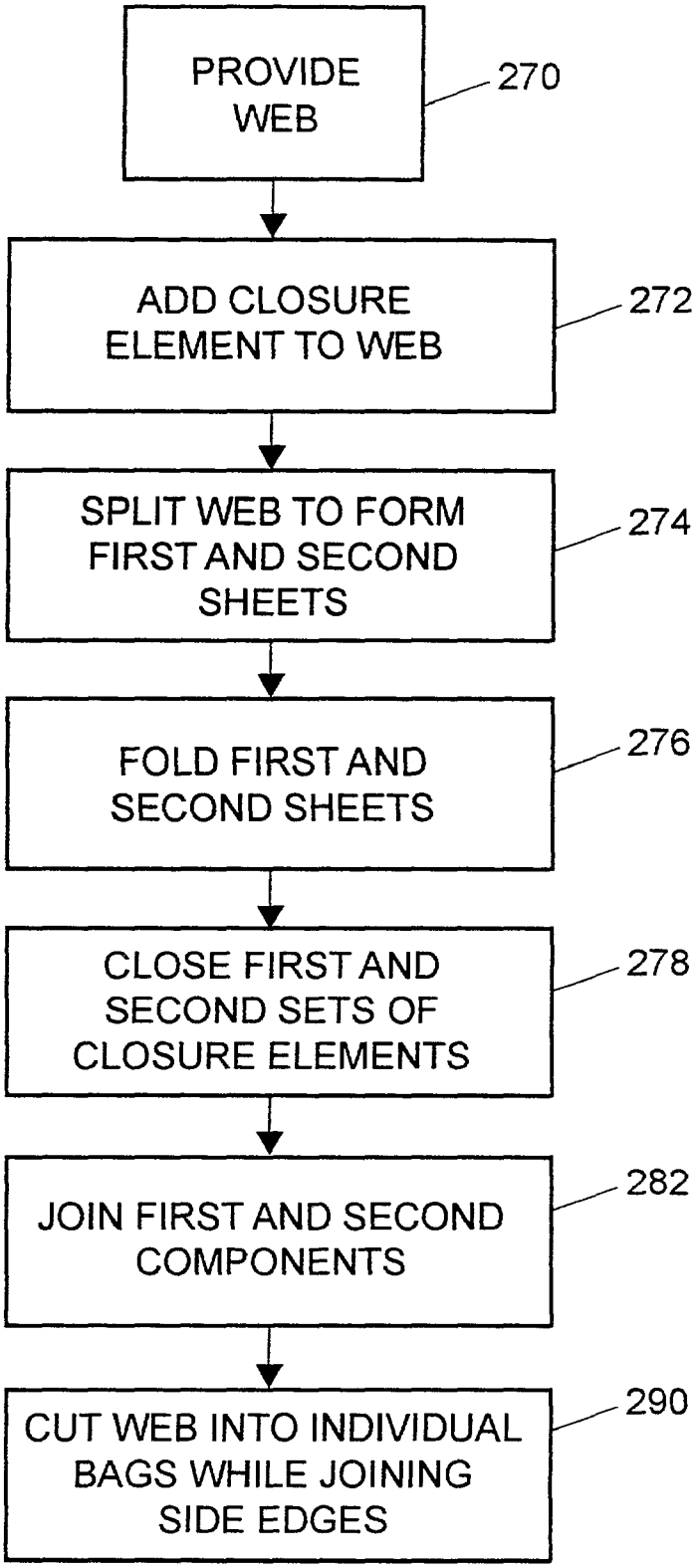
FIG. 13 is a flow chart of one method of making a bag in accordance with the teachings of the present disclosure.
Figure 13A:
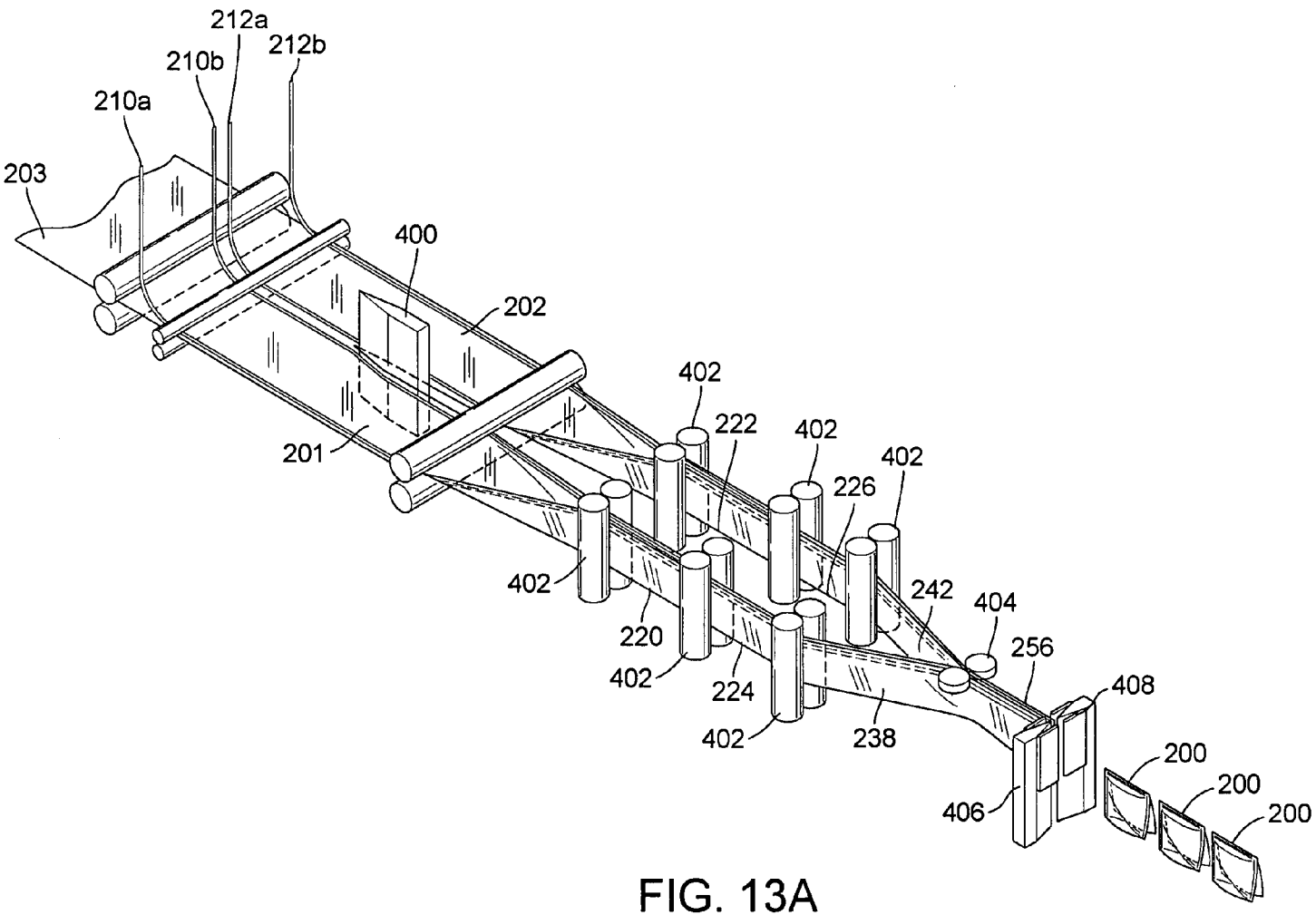
FIG. 13A is a persective view of a manufacturing line in accordance with the teachings of the disclosure showing a series of bags being manufactured.

The bag 200 may be made according to the method generally outlined in FIG. 13. First, as shown in step 270, the web 203 of thermoplastic film may be extruded by an extrusion process well known in the art. Second, as indicated by step 272, closure elements 210*a*, 210*b*, 212*a* and 212*b* are added to the web. As used herein, "added" is defined as any method by which the web 203 and the closure elements 210*a*, 210*b*, 212*a*, and 212*b* are combined. This may include, but is not limited to, integrally forming the web and closure elements by simultaneously extruding the web and closure elements, or in a post-applied process, such as, by means of lamination.

Step 274 describes the point at which the extruded web 203 is cut by knife 400 or separated into two sheets 201 and 202. Then, step 276 describes the folding of sheets 201 and 202 along fold lines 220 and 222 to form the bottom edge 224 and 226 of the first and second compartments 232 and 234, respectively. Once folded, the closure elements 210*a* and 210*b*, as well as closure elements 212*a* and 212*b*, are brought into confronting positions, whereupon in a step 278, such elements are zipped together. This may be performed, for example, by running the closure elements between nip rollers 402 or the like, which apply sufficient compressive force to join the closure elements together. After zipping, the sheets 201 and 202 forming the semi-completed compartments 232 and 234 are joined together in a step 280. This may be completed by depositing a bead of adhesive, or molten plastic, on one of the compartments and then pressing the two together. In one particularly advantageous embodiment a first bead 282 of adhesive is applied to at least one of outer surfaces 284, 286 of the inner walls 238 or 242 respectively, proximate the raised center lip 256, while a second bead 288 is applied to the at least one of the outer surfaces 284, 286 proximate the closure element 210*b* or 212*b*. Nip rollers 404 or the like can then be used to force the materials together and thereby form a bond.

After such steps, the first and second webs of folded plastic are joined together in a four-layer configuration with two bottom folds and two zippered tops. The only remaining step is to cut the web into individual multicompartment bags. As shown in a step 290, this may be accomplished by using a hot knife 406 against an anvil 408 or the like placed on opposite sides of the web. The heat of the hot knife melts the layers of plastic together, with the force of the knife and anvil severing the web. The result is a multicompartment bag with first and second heat-sealed sides, a folded bottom, and a zippered top.

Figure 14:
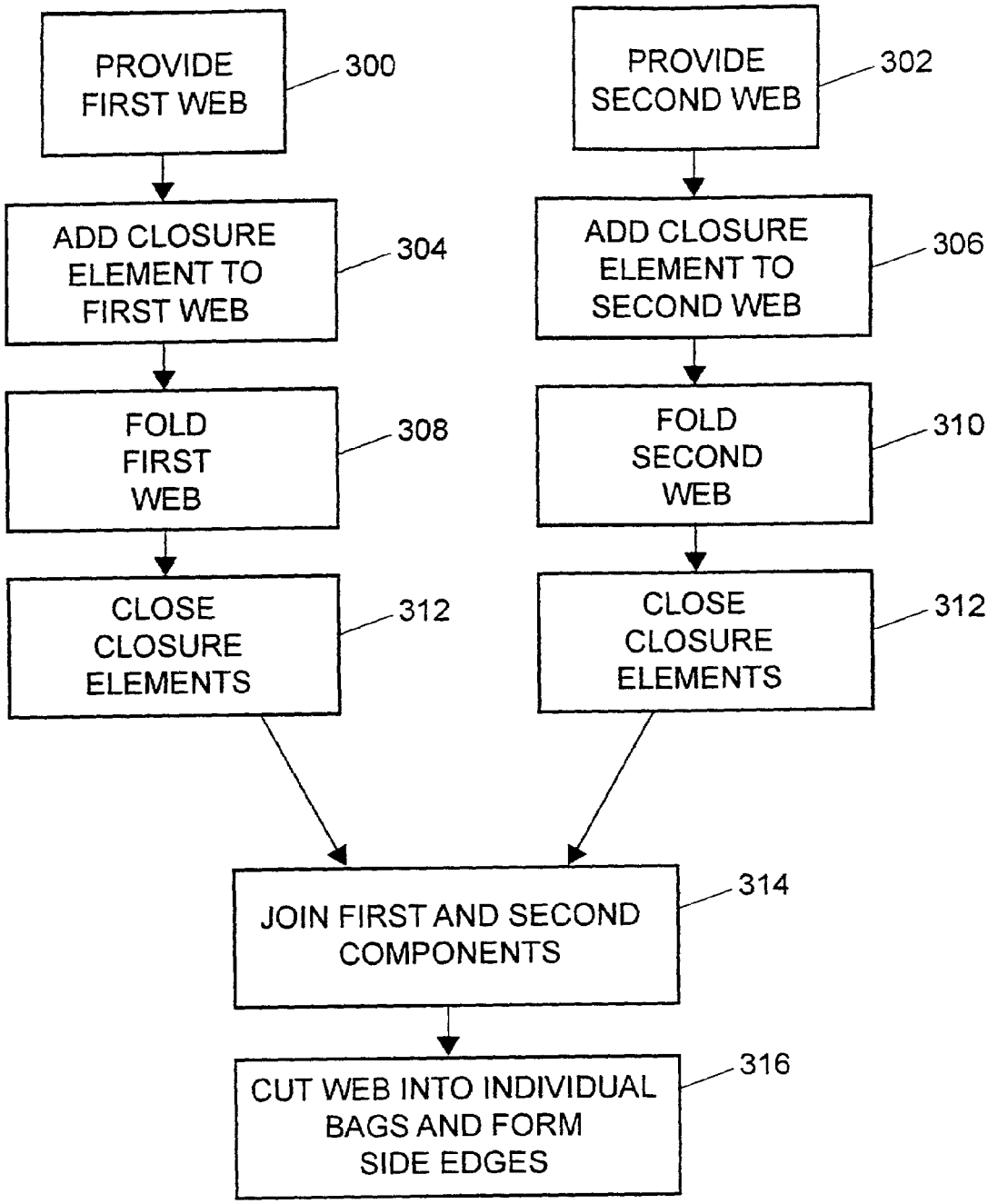
FIG. 14 is a flow chart of another method of making a bag in accordance with the teachings of the present disclosure.

Another method of making the bag 200 is shown in FIG. 14. First, as stated in steps 300 and 302, first and second webs are provided. This may be performed as by extruding first and second lines of thermoplastic material. As stated in steps 304 and 306, closure elements are then added to the first and second webs, respectively. Then, steps 308 and 310 describe the process of folding the first web to form a bottom edge for a first compartment and folding the second web to form a bottom edge for a second compartment.

Once the two webs are folded, the closure elements of each web are confronting each other and can be joined in a step 312. Similar to the embodiment of FIG. 13, the two webs can then be joined, as by adhesive, as shown in a step 314. A hot knife or the like can then be used to simultaneously heat seal side edges and sever the web into individual bags as shown in a step 316.

The following examples are not meant to limit the scope of the invention.

EXAMPLE 1

A multicompartment bag having two compartments is made. The first compartment has the dimensions 6.625 inches long (16.83 cm) by 7 inches wide (17.78 cm). The second compartment has the dimensions 4.75 inches long (12.06 cm) by 7 inches wide (17:78 cm).

Both of the sidewalls of the first compartment are 1.1 mils (0.028 mm) thick on average. Both of the sidewalls of the second compartment are 1.1 mils (0.028 mm) thick on average. A groove profile of a plastic zipper is disposed along the outer layer of the first compartment, formed by a cast integral extrusion process. Likewise, a groove profile of a plastic zipper is disposed along the outer layer of the second compartment, formed by a cast integral extrusion process. The rib profiles are aligned back-to-back along either side of a double-sided zipper tape, which is laminated to the top of the inner layer of the first compartment.

The two compartments are joined by a fold in the film between the two inner layers and by side seals along the side edges of the bag. The fold is about 0.5 inches (1.27 cm) below the plastic zipper when the zipper is closed. The laminated double-sided zipper tape extends upwardly from the fold such that the rib profiles on either side of the zipper tape can come into contact with and interlock with the groove profiles, thereby closing the compartments.

EXAMPLE 2

A multicompartment bag having two compartments is made. The first compartment has the dimensions 6.625 inches long (16.83 cm) by 7 inches wide (17.78 cm). The second compartment has the dimensions 4.75 inches long (12.06 cm) by 7 inches wide (17.78 cm).

Both of the sidewalls of the first compartment are 1.1 mils thick (0.028 mm) on average. Both of the sidewalls of the second compartment are 1.1 mils thick (0.028 mm) on average. A plastic zipper is disposed along the tops of both the first and second compartments.

The two compartments are joined by a fold in the film between the two inner layers and by an adhesive disposed between the two inner layers. In addition, the compartments are joined by side seals along the side edges of the bag.

EXAMPLE 3

A multicompartment bag having three compartments is made. The first compartment has the dimensions 8.5 inches long (21.59 cm) by 7 inches wide (17.78 cm). The second compartment is 6.625 inches long (16.83 cm) by 7 inches wide (17.78 cm). The third compartment is 4.75 inches long (12.06 cm) by 7 inches wide (17.78 cm).

The thicknesses of both of the sidewalls of the first compartment are 2.2 mils on average (0.056 mm). The thicknesses of both of the sidewalls of the second compartment are 1.1 mils on average (0.028 mm). The thicknesses of both of the sidewalls of the third compartment are 1.1 mils on average (0.028 mm).

A plastic zipper is disposed along the tops of both the first and second compartments. An adhesive closure is disposed along the top of the third compartment.

The compartments are joined by a fold in the film between adjacent layers and by an adhesive disposed between the adjacent layers. In addition, the compartments are joined by side seals along the side edges of the bag.

EXAMPLE 4

A multicompartment bag having two compartments is made. The first compartment has the dimensions 6.625 inches long (16.83 cm) by 7 inches wide (17.78 cm). The second compartment has the dimensions 4.75 inches long (12.06 cm) by 7 inches wide (17.78 cm).

The thicknesses of both of the sidewalls of the first compartment are 1.1 mils on average (0.028 mm). The thicknesses of both of the sidewalls of the second compartment are 1.1 mils on average (0.028 mm). A plastic zipper is disposed along the tops of both the first and second compartments.

The two compartments are joined by a fold in the film between the two inner layers and by an adhesive disposed between the two inner layers. In addition, the compartments are joined by side seals along the side edges of the bag.

The outer layer of the first compartment, which corresponds to layer 11 of FIG. 1, is microperforated. The microperforations have a diameter of 250 microns on average. There are 500 microperforations on the layer.

The outer layer of the second compartment, which corresponds to layer 14 of FIG. 1, is microperforated. The microperforations have a diameter of 850 microns on average. There are 100 microperforations on the layer.

EXAMPLE 5

A multicompartment bag having two compartments is made. The first compartment has the dimensions 6.625 inches long (16.83 cm) by 7 inches wide (17.78 cm). The second compartment also has the dimensions 6.625 inches long (16.83 cm) by 7 inches wide (17.78 cm).

The thickness of the outer sidewall of the first compartment is 3.5 mils on average (0.089 mm). The thickness of the inner sidewall of the first compartment is 0.8 mils on average (0.020 mm). Likewise, the thickness of the outer sidewall of the second compartment is 3.5 mils on average (0.089 mm), and the thickness of the inner sidewall of the second compartment is 0.8 mils on average (0.020 mm). A plastic zipper is disposed along the tops of both the first and second compartments.

The two compartments are joined by a fold in the film between the two inner layers and by an adhesive disposed between the two inner layers. In addition, the compartments are joined by side seals along the side edges of the bag.

The inner layers of both the first and second compartments are embossed. The pattern on the embossed layers appears to be a repeating diamond-shaped pattern.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A method of making a storage bag, the method comprising the steps of:

extruding a single web of thermoplastic film, the web being planar in shape and formed of a single layer;

adding closure elements to the web subsequent to the forming of the web;

cutting the web at a predetermined location on the web to create a first sheet and a second sheet each of the first and second sheet being planar in shape and formed of a single layer;

folding the first sheet to form first and second parallel layers meeting at a bottom edge of a first compartment;

folding the second sheet to form first and second parallel layers meeting at a bottom edge of a second compartment;

closing a closure element of the first compartment, the first compartment having an inner side wall and an outer side wall;

closing a closure element of the second compartment, the second compartment having an inner side wall and an outer side wall;

joining the first compartment to the second compartment, wherein the first compartment has a mouth at a top edge and the second compartment has a mouth at a top edge, the first and second compartments being joined at a point between the inner side wall of the first compartment and the inner side wall of the second compartment, the inner side walls joined together to create a central lip, the central lip extending above the top edges of the first and second compartments; and simultaneously joining the first and second side edges of the first and second compartments and severing the web into individual bags.

2. The method of claim 1, wherein the first sheet is folded at a predetermined location on the first sheet and the second sheet is folded at a predetermined location on the second sheet.

3. The method of claim 2, wherein the predetermined location on the first sheet is at a midpoint between first and second closure elements of the first sheet and the predetermined location on the second sheet is at a midpoint between first and second closure elements of the second sheet.

4. The method of claim 1, wherein the closure element of the first compartment is substantially aligned with the closure element of the second compartment.

5. The method of claim 1, wherein the first and second compartments are joined proximate the top edges of the first and second compartments.

6. The method of claim 5, wherein the first and second compartments are joined at a point between the closure element of the first compartment and the closure element of the second compartment.

7. The method of claim 1, wherein the first and second compartments are joined by at least one of the group consisting of an adhesive, a heat seal, an ultrasonic seal, an extruded lamination, and combinations thereof.

8. The method of claim 1, wherein the first compartment and the second compartment are joined by a continuous seal.

9. The method of claim 1, wherein the first compartment and the second compartment are joined by an intermittent seal.

10. The method of claim 1, further comprising the step of integrating the at least one closure element with the web.

11. The method of claim 1, further comprising the step of laminating the at least one closure element to the web.

12. The method of claim 1, further comprising the step of embossing the web.

13. The method of claim 1, further comprising the step of providing microperforations in the web.

14. The method of claim 1, wherein the side edges of the first and second compartments are sealed by at least one of the group consisting of hot wire sealing, hot knife sealing, ultrasonic sealing, adhesive sealing and combinations thereof.

15. The method of claim 1, wherein the closing steps involve forcing mating strips into frictional engagement.

* * * * *